United States Patent [19]

Dean

[11] Patent Number: 4,719,655

[45] Date of Patent: Jan. 19, 1988

[54] INVALID TRANSFER DEVICE

[76] Inventor: S. Brooks Dean, 2021 Washington Blvd., Huntington, W. Va. 25701

[21] Appl. No.: 902,590

[22] Filed: Sep. 2, 1986

Related U.S. Application Data

[63] Continuation-in-part of Ser. No. 820,240, Jan. 21, 1986, abandoned.

[51] Int. Cl.[4] ..... A61G 7/10

[52] U.S. Cl. ..... 5/81 R; 5/81 B; 5/86

[58] Field of Search ..... 5/81 R, 81 B, 86; 414/921

[56] References Cited

U.S. PATENT DOCUMENTS

| | | | |
|---|---|---|---|
| 503,105 | 8/1893 | Tingley | 5/81 R |
| 2,339,007 | 1/1944 | Gahm | 5/86 |
| 2,418,606 | 4/1947 | Smith | 5/86 |
| 2,470,524 | 5/1949 | Scudder | 5/81 R |
| 2,498,853 | 2/1950 | Hassold et al. | 5/81 B |
| 2,595,651 | 5/1952 | Feisty | 5/86 |
| 2,729,272 | 1/1956 | Lidge | 5/81 R |
| 2,747,652 | 5/1956 | Marsh | 5/86 |
| 2,854,673 | 10/1958 | Ramsey | 5/86 |
| 2,915,112 | 12/1959 | Schwartz | 5/81 R |
| 2,962,730 | 12/1960 | Carnes et al. | 5/86 |
| 3,654,643 | 4/1972 | Clanan | 5/86 |
| 3,790,974 | 2/1974 | Johansson | 5/81 R |
| 3,914,808 | 10/1975 | Woods | 5/86 |
| 4,065,179 | 12/1977 | Takasaki | 5/86 |
| 4,193,147 | 3/1980 | Fischer | 5/86 |
| 4,195,375 | 4/1980 | Paul | 5/81 R |

*Primary Examiner*—William F. Pate, III
*Assistant Examiner*—Michael Safavi
*Attorney, Agent, or Firm*—Nies, Webner, Kurz & Bergert

[57] ABSTRACT

An invalid lift and transfer device has two rigid cantilever frames, a first of which is caster supported for rolling along the ground and a second of which is supported on the first frame for vertical movement, which movement is actuated by a jack engaged therebetween. A patient sling is suspended between opposite sides of the second frame. The frames, in aggregate, define between them a space which at a rear end is open laterally and vertically sufficiently to accept a wheelchair, bed, toilet or other patient support and which at the forward end is open up to a height sufficient to permit the leg and foot supports of the wheelchair, with the patient's legs and feet thereon, to project therethrough forwardly of the frames.

6 Claims, 3 Drawing Figures

INVALID TRANSFER DEVICE

This is a continuation-in-part of applicant's U.S. patent application Ser. No. 06/820,240 filed Jan. 21, 1986, now abandoned.

The present invention relates generally to invalid lift and transfer devices for lifting sitting patients, depositing the patients on wheelchairs, beds, chairs, toilets and the like and for transporting patients short distances.

Devices intended to accomplish these general purposes have been proposed in the past. Such devices are disclosed for example in U.S. Pat. Nos. 503,105; 2,339,007; 2,418,606; 2,470,524; 2,498,853; 2,595,651; 2,729,272; 2,747,652; 2,854,673; 2,915,112; 2,962,730; 3,654,643; 3,790,974; 3,914,808 and 4,195,375. However these devices lack one or more of the features necessary to satisfy the rather stringent requirements which must be met to meet the needs of the manufacturer and of the user.

Usually, some sort of jack mechanism is utilized for the purpose of raising or lowering a patient lifting frame which is supported on a main frame in turn supported on casters or similar means to permit its movement from place to place.

In most of the prior devices, frames are open at the back so that a wheelchair, for example, may enter partially within the framework. The jacking mechanism and associated frame parts are relegated to the front of the device and insofar as is known they invariably block the front so that the leg and foot supports of a wheelchair can not project forwardly past the framework and hence the device is unduly long or cumbersome or there is insufficient floor space to accommodate the patient entirely within the framework.

With the foregoing considerations in mind it is a primary purpose and object of the present invention to provide a patient lift and transfer device which permits free and unimpeded movement of the device to a position essentially encompassing a wheelchair or other chair or a bed or a toilet to permit transfer of a patient to and from the device while minimizing or eliminating alltogether any substantial movement by the patient.

It is a further object of the present invention to provide a device which is of minimum physical size, which is characterized by lightweight, stability and which provides patient security during all phases of lift and transfer.

It is also an object of the present invention to provide a device which is relatively inexpensive to manufacture and to maintain and which is durable and has an extended service life.

It is a more specific object of the present invention to provide a device of the type described comprised essentially of two frame assemblies, one being a chassis and the other being a patient sling support, both assemblies being inverted U-shaped members with a pair of laterally spaced parallel arms projecting rearwardly therefrom which constitute cantilevers of substantial strength and rigidity.

The legs of the inverted U-shaped patient supporting frame telescopically engage in the hollow legs of the chassis frame member thus achieving extra long bearings to facilitate raising and lowering the frame without binding despite the heavy loads imposed by the weight of the patient seated on the movable frame.

Additional objects and advantages will become apparent as the description proceeds in connection with the accompanying drawings in which.

Figure 1:
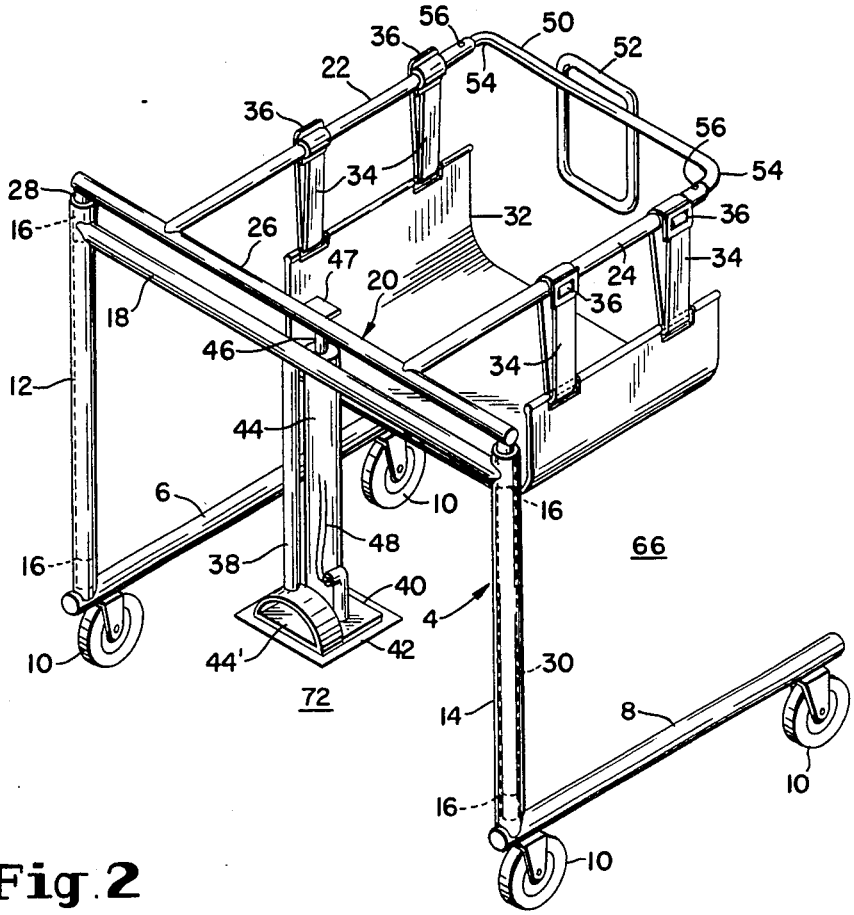
FIG. 1 is an isometric view of one embodiment of the invention.
Figure 2:
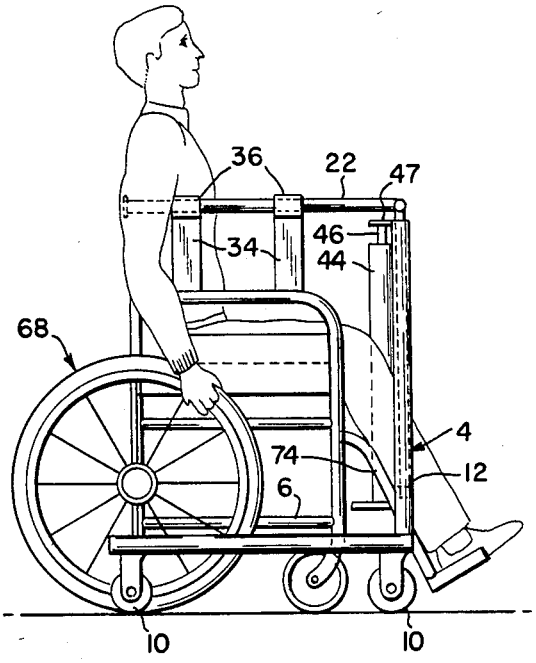
FIG. 2 is a side elevation of the device shown in FIG. 1.

Referring now to the drawings, and particularly the embodiment of the invention shown in FIGS. 1 and 2, the invalid lift and transfer device comprises a chassis frame 4 formed of a pair of spaced parallel horizontal arms 6 and 8 supported on casters 10. Rigid with and extending upwardly from corresponding ends of the horizontal arms are vertical hollow tubular posts 12 and 14 held in spaced apart parallel relation by a cross bar 18 welded or otherwise suitably rigidly secured to the upper ends of the posts 12 and 14.

A patient lifting frame 20 is supported on chassis frame 4 for vertical movement and consists of a pair of spaced parallel horizontal arms 22, 24 rigidly connected at corresponding ends by cross bar 26. Rigid with and depending from opposite end portions of cross bar 26 are vertical posts 28 and 30 slidably engaging in the vertical hollow tubular posts 12 and 14 of the chassis frame. Preferably Teflon ® bearings 16 are provided to facilitate free vertical movement of the posts 28 and 30. Suspended between the arms 22 and 24 of frame 20 is a sling 32, which may have a hole for toilet use, the suspending straps 34 for which are lengthwise adjustable by means of buckles 36 so that the sling may be leveled or vertically adjustable as desired.

Projecting downwardly from the mid point of the cross bar 18 is a column 38 which carries a platform 40 at its lower end, the bottom and edges of which are protected by a rubber pad 42. Preferably the parts are so dimensioned that the undersurface of the pad 42 is disposed at least 10 inches above the floor or other supporting surface for a purpose to appear. A hydraulic jack 44 is supported on the platform 40 and has a plunger 46 which at its upper end freely makes contact with lift tab 47 which welds to the cross bar 26. For convenience a jack handle 48 is removably supported on a platform 40.

A retainer bar 50 carrying a backrest 52 is provided with bent ends 54 which extend into the rear ends of the hollow tubular bars 22 and 24 and is adjustably and releasably held in place by pins 56.

In a typical case the frame members 12 and 14 are spaced apart approximately 36 inches and in its lowered position the cross member 26 is approximately the same distance above ground level to provide an unobstructed area at the front of the unit to accommodate the patient's feet and legs and the front portion of the wheelchair. The horizontal arms 22 and 24 which support the patient carrying sling 32 are typically some 19 inches apart and 24 inches long. The bottom support members 6 and 8 are somewhat longer so that the overall dimension, front to rear, of the device is approximately 27 inches. The device can be made of any suitable materials, typically 1" or 1¼" steel tubing.

In operation, the retainer bar 50 is removed and the sling 32, if not already under the patient is removed from the frame 20 and centered under the patient who is seated on a bed, wheelchair or other support. The patient is approached from the front and the device is moved back until the free ends of the horizontal bars 22 and 24 are approximately flush with the patient's back. Any necessary adjustments in the height of the frame can be made by operation of the jack.

The sling is then installed and the straps are pulled taut through buckles 36 making the sling approximately level. The retainer bar 50 is then installed and the jack 46 is actuated to raise the patient free of the bed or chair on which he is seated. The patient is then moved to a new seat or bed and the jack 46 is operated so as to lower the patient onto the new seat or bed thus relieving the tension on the straps 34 which can be disengaged. If desired, the patient may remain seated on the sling, and may be readily moved.

Figure 3:
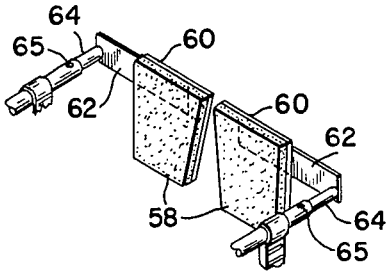
FIG. 3 is a fragmentary isometric view of a modification of a portion of the device of FIGS. 1 and 2.

The presently preferred embodiment of the invention fragmentarily illustrated in FIG. 3 is the same as the previously described embodiment except for the retainer assembly at the rear of the upper frame. In this form of the invention the rear retainer comprises a pair of symmetrically opposite independently movable support assemblies each comprising a foam rubber pad 58 backed by a sheet of plywood or metal 60 carried by an arm 62 mounted in the arms 22 or 24 by tubular members 64. The tubular members 64 are freely rotatable in the arms 22 and 24 but may be held in the adjusted horizontal position by shear pins 65.

When a patient is positioned in or removed from the device the retainer structures are rotated 180° to positions where they do not interfere with the movement of the patient. After a patient is seated within the device, the retainer structure members can be rotated back to their horizontal position as shown in FIG. 3 to provide a secure and comfortable backrest.

Both embodiments are characterized by rearwardly facing open spaces 66 between the frame arms 6 and 8 sufficient to accommodate a wheelchair 68 with a patient seated thereon, and forwardly facing open spaces 72 at the front sufficient to allow the leg and foot supports 74 of the wheelchair, with the patient's leg and feet thereon, to project therethrough forwardly of the frames as shown in FIG. 2.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An invalid lift and transfer device comprising, a rigid chassis frame formed of a pair of parallel horizontal bars lying in a plane providing a space therebetween, a pair of tubular posts rigidly connected to and extending vertically upward from corresponding ends of said horizontal bars, and a first cross bar rigidly connected to and extending between upper end portions of said vertical tubular posts, said first cross bar providing the sole connection between said vertical tubular posts there being no connection between said horizontal bars in the plane of said horizontal bars, said space between said horizontal bars thereby being unobstructed to permit the feet and legs of a patient to project forwardly of said corresponding ends of said bars, a rigid invalid lifting frame movably supported on said chassis frame comprising a pair of parallel horizontal arms providing a space therebetween, a second cross bar rigidly connected to and extending between corresponding ends of said horizontal arms, and a pair of vertical posts extending downwardly from opposite end portions of said second cross bar, the vertical posts of said invalid lifting frame telescopically engaging in the vertical tubular posts of said chassis frame, jack means engaging between said frames for raising and lowering said invalid lifting frame with respect to the chassis frame, and a sling supported from the arms of the invalid lifting frame, said jack means comprising a body member and an extensible plunger member, a column extending downwardly from said first cross bar substantially centrally thereof, a platform on the lower end of said column, one of said jack members being supported on said platform and the other of said jack members engaging said second cross bar intermediate the ends thereof.

2. An invalid transfer device as claimed in claim 1, and a retainer means carried by the ends of said horizontal arms which are remote from the ends to which said second cross bar is connected, said retainer means being movable into and out of retaining position.

3. An invalid transfer device as claimed in claim 1, and an invalid retainer and back rest comprising a pair of retainer assemblies, each assembly including a support pad carried by an arm rotatably mounted in the end of one of said arms remote from the end to which said second cross bar is connected.

4. The device according to claim 1, wherein said jack means comprises a hydraulic jack, said body member being supported on said platform and said plunger engaging said second cross bar.

5. The device according to claim 1 together with wheels mounted on the opposite ends of said horizontal bars.

6. The device according to claim 1 wherein the space between said horizontal arms is sufficient to accommodate an invalid and the space between said horizontal bars is substantially greater than the space between said horizontal arms to assure stability of the device and secure the invalid.

* * * * *